US007877842B2

(12) United States Patent
Bagley

(10) Patent No.: US 7,877,842 B2
(45) Date of Patent: Feb. 1, 2011

(54) TOOL SYSTEM WITH REPLACEABLE HEADS AND OFFSET HANDLE

(75) Inventor: Perry S. Bagley, Cumming, GA (US)

(73) Assignee: ComfortGlide, Inc., Cumming, GA (US)

( * ) Notice: Subject to any disclaimer, the term of this patent is extended or adjusted under 35 U.S.C. 154(b) by 0 days.

(21) Appl. No.: 12/493,728

(22) Filed: Jun. 29, 2009

(65) Prior Publication Data

US 2009/0260170 A1 Oct. 22, 2009

Related U.S. Application Data

(63) Continuation of application No. 11/769,451, filed on Jun. 27, 2007.

(60) Provisional application No. 60/816,728, filed on Jun. 27, 2006, provisional application No. 60/915,943, filed on May 4, 2007.

(51) Int. Cl.
*B25G 3/32* (2006.01)

(52) U.S. Cl. ..... 16/422

(58) Field of Classification Search ..... 16/422, 16/406, 413; 15/144.1, 171, 172, 145, 176.1, 15/178, 202; 29/428; 53/396; 30/329, 337; 401/207, 290

See application file for complete search history.

(56) References Cited

U.S. PATENT DOCUMENTS

| | | | | |
|---|---|---|---|---|
| 2,147,310 | A | | 2/1939 | Morrison |
| 2,526,756 | A | | 10/1950 | Krebs |
| 2,558,290 | A | | 6/1951 | Brown et al. |
| D167,775 | S | * | 9/1952 | Schmidt ..... D4/132 |
| 2,792,581 | A | * | 5/1957 | Woyton ..... 15/144.1 |
| 2,820,290 | A | * | 1/1958 | Porter, Jr. ..... 30/136 |
| 2,838,835 | A | | 6/1958 | Jepson |
| D199,520 | S | * | 11/1964 | Jones ..... D4/129 |
| 3,273,192 | A | * | 9/1966 | Mazzella ..... 15/230.11 |
| 3,367,578 | A | | 2/1968 | Juvinall et al. |
| 3,369,268 | A | * | 2/1968 | Burns et al. ..... 15/210.1 |
| D212,668 | S | * | 11/1968 | Miller ..... D4/132 |
| 3,408,676 | A | * | 11/1968 | Cayo ..... 15/230.11 |
| 3,596,304 | A | | 8/1971 | Welt |
| 3,757,376 | A | | 9/1973 | Coombes |
| 3,874,021 | A | | 4/1975 | Jacobs |
| D240,678 | S | * | 7/1976 | Herig ..... D4/138 |
| 4,089,082 | A | * | 5/1978 | McGrew ..... 15/230.11 |
| D255,845 | S | * | 7/1980 | Wood ..... D4/132 |

(Continued)

FOREIGN PATENT DOCUMENTS

| | | |
|---|---|---|
| BE | 497801 | 12/1950 |

(Continued)

*Primary Examiner*—Shane Bomar
*Assistant Examiner*—Roberta Delisle
(74) *Attorney, Agent, or Firm*—Thomas, Kayden, Horstemeyer & Risley, LLP; Todd Deveau

(57) ABSTRACT

A tool system is disclosed having a body including a handle extending therefrom, a detachable head including a working tool, and a multi-part connector for detachable connecting the head to the body, the connector including opposed, flexible members positioned on the body towards an end of the body and means on the head for connecting with the opposed flexible members, the opposed flexible members and the means for connecting with the flexible members working in concert to detachably secure the head to the body. The handle of the tool system can be offset with respect to the axis of the body and the detachable head.

22 Claims, 5 Drawing Sheets

U.S. PATENT DOCUMENTS

| | | | | |
|---|---|---|---|---|
| 4,469,223 | A | 9/1984 | Smith | |
| 4,494,268 | A | 1/1985 | Chu | |
| 5,207,755 | A * | 5/1993 | Ampian | 15/230.11 |
| 5,226,198 | A | 7/1993 | Martin | |
| 5,366,314 | A | 11/1994 | Young | |
| 5,502,859 | A | 4/1996 | Kim | |
| D371,002 | S | 6/1996 | Berti | |
| 5,752,619 | A | 5/1998 | Fulton | |
| 5,802,658 | A * | 9/1998 | Ward | 15/144.2 |
| 5,926,903 | A | 7/1999 | Kim | |
| D413,445 | S | 9/1999 | deBlois et al. | |
| D416,390 | S | 11/1999 | Corriveau | |
| 6,035,481 | A | 3/2000 | Douglas et al. | |
| 6,230,357 | B1 | 5/2001 | Davis | |
| 6,345,406 | B1 | 2/2002 | Dodd | |
| 6,438,784 | B1 | 8/2002 | Yu | |
| 6,473,929 | B1 | 11/2002 | Learned, III | |
| 6,546,585 | B1 | 4/2003 | Blaustein et al. | |
| 6,681,436 | B2 | 1/2004 | Nilsson | |
| D495,145 | S | 8/2004 | Gladden | |
| D501,324 | S | 2/2005 | Berti | |
| 2002/0148058 | A1 | 10/2002 | Greenwood et al. | |
| 2002/0194690 | A1 * | 12/2002 | Vaes et al. | 15/159.1 |
| 2003/0009840 | A1 * | 1/2003 | Karsten | 15/230.11 |
| 2003/0217424 | A1 | 11/2003 | Stone | |
| 2004/0154119 | A1 * | 8/2004 | Bullock | 15/172 |
| 2004/0187242 | A1 * | 9/2004 | Hitzler | 15/172 |
| 2005/0204497 | A1 * | 9/2005 | Hillenbrand | 15/172 |

FOREIGN PATENT DOCUMENTS

| | | |
|---|---|---|
| DE | 916406 | 8/1954 |
| FR | 714282 | 11/1931 |
| FR | 894974 | 3/1944 |
| FR | 2428418 | 11/1980 |
| FR | 2624766 | 6/1989 |
| GB | 606536 | 12/1945 |
| GB | 886285 | 5/1958 |
| IT | 429280 | 3/1947 |

* cited by examiner

TOOL SYSTEM WITH REPLACEABLE HEADS AND OFFSET HANDLE

This application is a continuation of U.S. patent application Ser. No. 11/769,451 filed Jun. 17, 2007, which claims priority to and benefit of U.S. Provisional Patent Applications assigned Ser. No. 60/816,728 filed Jun. 27, 2006 and Ser. No. 60/915,943 filed May 4, 2007, which are incorporated by reference in their entirety.

BACKGROUND

Painting, for example, residential painting, typically involves use of a variety of tools, such as paint brushes and rollers, paint scrapers, putty knives, and razor blades. The conventional tool has both a handle and a tool head. Usually, the head is permanently attached to the body such that the head cannot be separated from the body. A typical head features a paint applicator such as a brush formed of bristles, a sponge, or a roller. Often, bristles are permanently attached to the handle using a ferrule, which is a metallic clamp that surrounds a lower portion of the bristles and an upper portion of the handle to bind the bristles to the handle.

Tools featuring different heads may be useful for different purposes. Therefore, a user normally purchases and maintains separate paintbrushes having heads of various sizes, shapes, and materials. The same can be said for paint rollers, paint scrapers and putty knives. The result can require a significant investment in tools.

U.S. Patent Publication No. 2002/0148058 attempts to overcome this disadvantage by disclosing a tool having a detachably interconnected handle and paint applicator. This system allows for detaching and replacing paint applicator heads from the handle. This system has the disadvantage of involving a relatively complicated connector for connecting the head to the handle. Further, the primary connector component is attached to the brush head placing a significant cost of the connector on the replaceable and ultimately disposable head.

Moreover, the head of the conventional paint brush or tool brush is normally aligned with the body and the handle of the brush along a common axis, such that the handle is on an axis substantially parallel to and in line with the head, or in the case of a paint roller at a 90° angle with respect to the axis of the roller. As a result of this design, an awkward hand and wrist motion may be required for performing tasks such as painting walls, which are usually perpendicular to the axis of the brush.

SUMMARY

The tool system of the present disclosure is directed to overcoming the aforementioned disadvantages. The tool system has a body including a handle, a detachable head including a working tool, and a multi-part connector for detachably connecting the head to the body. One part of the connector is at an end of the body and another part of the connector is included with the detachable head. The one part of the connector at an end of the body includes opposed, flexible members positioned thereon. The other part of the connector included with the detachable head includes means for connecting with the opposed, flexible members. The body has an elongated handle extending therefrom forming an end opposite the end of the body having one part of the connector.

In an exemplary embodiment, the handle of the tool system is offset with respect to the body, such that the axis of the handle is at an angle with respect to the axis of the body and detachable head. The handle may also be scalloped, or have grooves or indentations.

In a further exemplary embodiment, the end of the body having the opposed, flexible members includes an opening formed therein and the detachable head includes an extension member generally having the shape of the opening in the body designed to be received within the opening of the body, and means associated with the opening for releasably securing the detachable head to the body. The means associated with the opening in the body for releasably securing the detachable head to the body can include compressible abutments forming a gap therebetween positioned within the opening for mating with the extension member of the detachable head. The extension member can have an enlarged distal end and be of a length such that it extends into the opening beyond the flexible abutments and positions the enlarged end below the flexible abutments. The opening in the one end of the body, its flexible abutments and the extension member thus form a multi-part connector working in concert to releasably secure the detachable head to the body.

In another exemplary embodiment the opposed, flexible members are flexible detent or tab members positioned on the body at an end thereof and the end of the body includes a hollow therein. One or more flexible detent or tab members can be positioned about the hollow and are capable of being flexed inwardly into the hollow. The tab members can each have an outward extension and the means on the detachable head for connecting with the flexible members includes means for receiving the one or more extension members. The flexible tab members including extension members and the means for receiving the extension members form a multi-part connector working in concert to releasably secure the detachable head to the body.

The detachable head can include anyone of a variety of working tools typically associated with the painting process. For example, the head can include a paint applicator, such as a bristle brush, a sponge applicator, or a roller. The head can also include other tools associated with painting such as a paint scraper, a razor blade, a putty knife or a wire bristle brush. The tools can have a variety of different sizes and shapes.

Further, the handle and the detachable heads of the present paint tool system can be sold either together or separately or both.

In yet a further exemplary embodiment, a handle is provided for a tool system, the handle designed for use with a detachable head including a working tool, the handle comprising a body portion and a handle extending therefrom. A multi-part connector is provided for detachably connecting the body portion of the handle to a detachable head, the connector including opposed, flexible members positioned on the body towards an end thereof designed to mate with a detachable head.

Other systems, devices, features, and advantages of the disclosed brush will be or will become apparent to one with skill in the art upon examination of the following drawings and detailed description. All such additional systems, devices, features, and advantages are intended to be included within this description, are intended to be included within the scope of the present invention, and are intended to be protected by the accompanying claims.

BRIEF DESCRIPTION OF THE FIGURES

The present disclosure may be better understood with reference to the following figures. Matching reference numerals designate corresponding parts throughout the figures, and components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary the intent is to cover all alternatives, modifications and equivalents.

DETAILED DESCRIPTION

Figure 1:
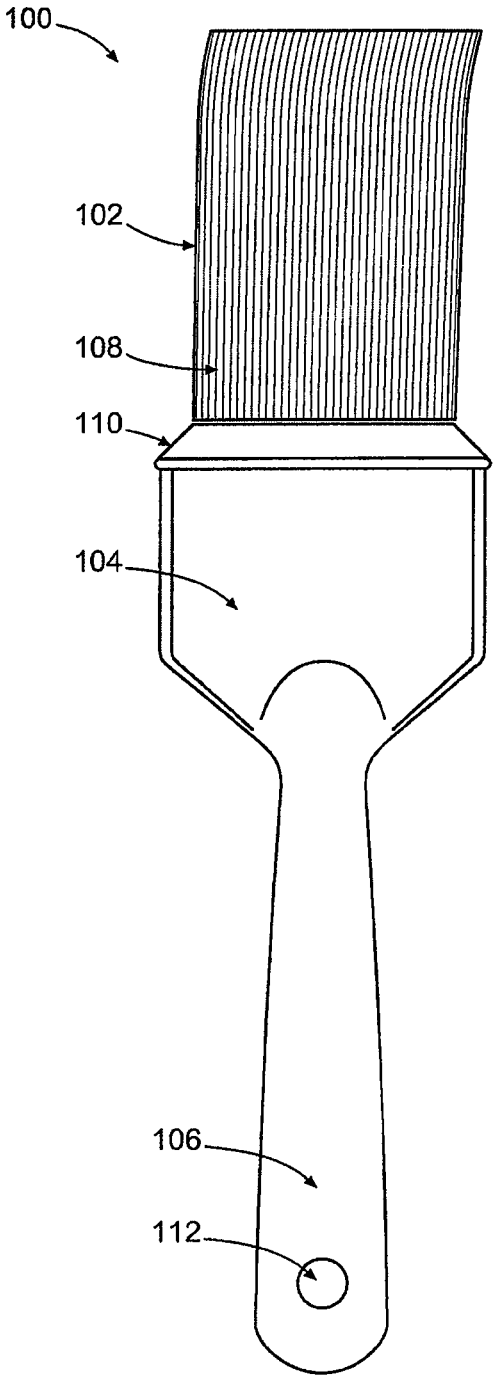
FIG. 1 is a front view of a first embodiment of the present tool system having a detachable tool head.

Referring more specifically to the drawings, FIG. 1 is a front view of an exemplary embodiment of a paint tool system 100 of the present disclosure having a body 104, a handle 106 extending from the body and a detachable head 102 that may be selectively attached to and detached from the body 104. In this embodiment the head 102 includes a brush element 108 attached to a base 110. The brush element 108 is described below with reference to FIGS. 3-8 and may comprise, for example, a plurality bristles. The base 110 of the head 102 has a width that is approximately the same as a width of the body 104 of the system 100 and in one embodiment may be, for example, approximately two and one half inches wide. The body 104 tapers to the width of the handle 106, which is narrower than the width of the body 104. For example, the handle 106 may be approximately one inch wide. The handle 106 is elongated with respect to the body 104. For example, the handle 106 may be approximately four and one half inches long. The handle 106 may have a hole 112 at a distal end that facilitates hanging the tool system 100 to store it. In this embodiment, the handle is aligned with the body and the head. In a preferred embodiment, the handle is offset from such alignment as described in more detail below in connection with FIGS. 9,11 and 12.

A variety of materials can be used for the various components of the system. For example, the body 104 and the handle 106 can be made from plastic and the base 110 made from metal. In other embodiments, the components of the system can all be made of a hard plastic or from other materials. For example, the body 104 and the handle 106 can both be made from wood and the body 104 and handle 106 can be a unitary design or separate connected components.

Figure 2:
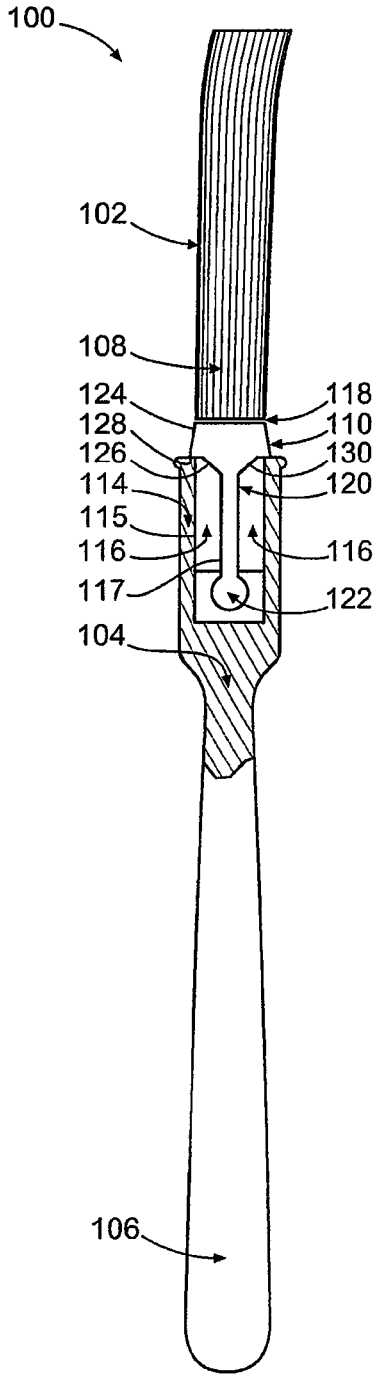
FIG. 2 is a cut-away side view of the embodiment of the system illustrated in FIG. 1.

FIG. 2 is cut-away side view of the embodiment of the system illustrated in FIG. 1. As shown, the body 104 has an exterior wall 114 that defines an opening 115 in one end of the body 104 opposite the handle 106 within an interior of the body 104. Within the opening 115 are two opposed flexible and/or compressible abutments 116, though only one compressible abutment may be used, or more than two compressible abutments used. In FIG. 2 each abutment 116 is adjacent a section of the exterior wall 114 extending along the width of the body 104, and each abutment 116 is spaced apart from the other abutment such that a gap 117 is formed between the abutments. The flexible abutments 116 may be formed from a flexible material such as a semi-hard or compressible rubber.

The base 110 includes a cap 118 and an extension member or projection 120. The cap 118 can be substantially oblong-shaped, with the brush element 108 extending from a top side of the cap and the projection 120 extending from a bottom side of the cap. In an exemplary embodiment, the extension member or projection 120 is substantially planar with an enlarged distal end, such as bulbous or beaded edge 122 running along the width of the projection.

The head 102 is configured to mate with the body 104 to attach the head 102 to the system 100. Specifically, the cap 118 is sized and shaped to mate with the flexible abutments 116, and the extension member or projection 120 is sized and shaped to fit within the gap 117 between the abutments with the enlarged distal end 122 positioned below the abutments to releasably secure the head 102 to the body 104. Therefore, the projection 120 may be about as thick as the gap 117 between the abutments 116, and the enlarged distal end 122 may be wider than the gap 117 between the abutments.

For example, the cap 118 includes an upper portion 124 and a lower portion 126. The upper portion 124 of the cap 118 is an elongated member having a shape to neatly transition from the shape of the working tool member of the head to the shape of the upper portion of the body 104, such as a trapezoidal cross-section. Similarly, the lower portion 126 of the cap 118 is an elongated member having a shape to transition to and mate with the shape of the upper portion of the abutments, such as a triangular cross-section. A slight lip 128 is formed at the intersection of the upper portion 124 and lower portion 126 of the cap 118. The element 108 is attached to the upper portion 124 of the cap 118, and the projection 120 extends from the lower portion 126 of the cap. Upper surfaces 130 of the flexible abutments 116 are tapered to preferably match the shape of the lower portion 126 of the cap 118, and the gap 117 between the flexible abutments 116 matches the shape of the projection 120.

In this exemplary embodiment, the body 104 of the tool system 100 is approximately 0.75 inches thick, the exterior wall 114 is about 0.125 inches thick, the flexible abutments are each about 0.5 inches thick, and the projection 120 is about 0.125 inches thick. The upper portion 124 of the cap 118 tapers from about 0.625 inches thick at the widest point to about 0.5 inches thick at the narrowest point.

To attach the head 102 to the body 104, the projection 120 is inserted into the gap 117 in the body 104. The trapezoidal shape of the upper portion 124 of the base 110 facilitates grasping the base and applying pressure to it. The enlarged distal end 122 of the projection 120 is inserted into the base of the gap 117 between the flexible abutments 116. Because the abutments 116 are formed from a flexible and/or compressible material and the projection 120 is formed from a non-flexible material, such as a metal or a stiff plastic material, the abutments may deflect or compress to allow the end 122 through the gap 117. Once the end 122 has passed the abutments, the flexible abutments 116 may return to their normal position. The lower projection 120 extends between the flexible abutments 116 with the end 122 lying below the abutments 116 to secure the projection 120 in the gap 117. Once the head 102 is attached, the upper portion 124 of the cap 118 lies above the body 104 with the lip 128 resting on the exterior wall 114, and the lower portion 126 of the cap 118 resting on the upper surfaces 130 of the flexible abutments 116 within the opening 115 of the body. The head 102 can be detached from the body 104 by pulling the head from the body, which causes the flexible abutments 116 to deflect or compress such that the enlarged distal end 122 can pass through the gap 117 and out of the opening 115.

The embodiment described above is merely an example, and other configurations are possible. For example, each of the body 104, exterior wall 114, flexible abutments 116, gap 117, cap 118, extension member or projection 120, and enlarged distal end 122 may have the same general shape as described above but may have other dimensions. For example, the projection 120 may be slightly thicker than the gap 117 between the flexible abutments 116, but may be less thick than the end 122. In such an embodiment, the flexible abutments 116 may apply pressure to the projection 120 once the head 102 is attached to the body 110, to further secure the head 102 to the body 104. In other embodiments, some of the identified parts may be shaped differently. For example, the upper portion 124 of the cap 118 need not have a trapezoidal cross-section, and the lower portion 126 of the cap need not have a triangular cross-section. The lip 128 between the upper portion 124 and the lower portion 126 may be omitted, in which case the upper portion 124 of the cap 118 rests directly on the flexible abutments 116. In fact, the lower portion 126 of the cap 118 may also be omitted in which case the projection 120 extends from the underside of the upper portion 124 of the cap. The end 122 may also have a different shape such as a shape having a rectangular or triangular cross section, having a wider dimension than the projection.

FIGS. 3-8 illustrate various exemplary, alternative embodiments of detachable heads that can be used with the tool system 100 described above. Each of the detachable heads includes the base 110 described above, and a working tool or element that is attached to the base.

Figure 3:
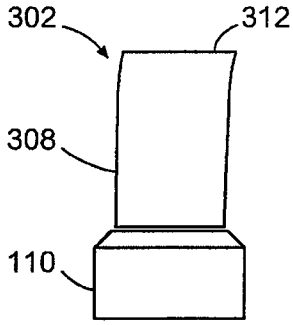
FIG. 3 is a front view of a first embodiment of a detachable head with a working tool that can be used with the system shown in FIG. 1.

FIG. 3 is a front view of a first embodiment of a detachable head 302 that can be used with the system 100 shown in FIG. 1. The working tool or element 308 can be formed of a plurality of bristles attached to the base 110. The bristles can be formed from animal hair, synthetic fibers, or other materials. The element 308 can be, for example, about 1.5 inches wide, and each bristle is about the same length, such that the element has a straight distal edge 312.

Figure 4:
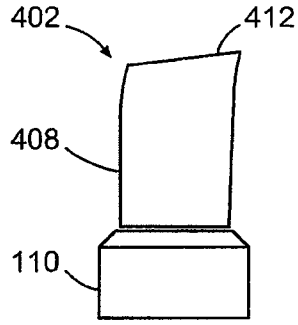
FIG. 4 is a front view of a second embodiment of a detachable head with a working tool that can be used with the system shown in FIG. 1.

FIG. 4 is a front view of a second embodiment of detachable head 402 that can be used with the system 100 shown in FIG. 1. Like the head 302 shown in FIG. 3, the working element 408 can have a plurality of bristles attached to the base 110. The working element 408 can be wider than element 308, for example, about 2 inches wide, and the bristles can vary in length such that the element has a tapered distal edge 412. An element 408 having such a tapered distal edge 412 may be well suited for painting trim.

Figure 5:
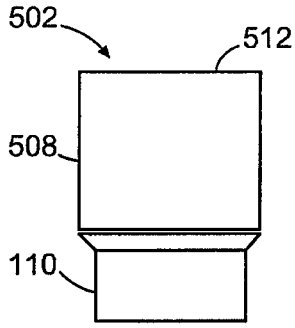
FIG. 5 is a front view of a third embodiment of a detachable head with a working tool that can be used with the system shown in FIG. 1.

FIG. 5 is a front view of a third embodiment of a detachable head 502 that can be used with the system 100 shown in FIG. 1. The working element 508 of the head 502 can be, for example, a sponge material attached to the base 110, which may be formed from a natural or a synthetic material. As shown, the element 508 is wider than elements 308 and 408, for example, about 3 inches wide, and has a straight distal edge 512.

Figure 6:
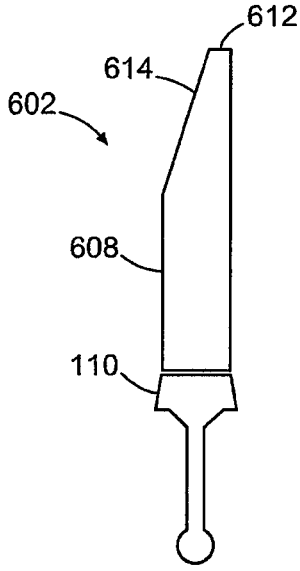
FIG. 6 is a side view of a fourth embodiment of a detachable head with a working tool that can be used with the system shown in FIG. 1.

FIG. 6 is a side view of a fourth embodiment of a detachable head that can be used with the system 100 shown in FIG. 1. Like the head 502 shown in FIG. 5, the working element 608 of the head 602 can be a sponge material attached to the base 110. As illustrated, the distal edge 612 of the element is straight. In this embodiment, a back portion 614 of the element 608 is cut away or tapered to facilitate the application of paint.

Figure 7:
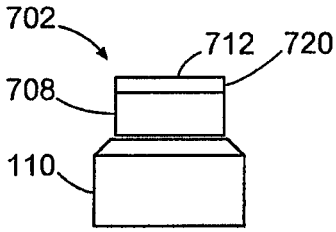
FIG. 7 is a front view of a fifth embodiment of a detachable head with a working tool that can be used with the system shown in FIG. 1.

FIG. 7 is a front view of a fifth embodiment of a detachable head 702 that can be used with the body 104 shown in FIG. 1. The working element 708 includes a holder attached to the base 110. A razor blade 720 having a relatively sharp distal edge 712 can be placed within the holder of the element 708.

Figure 8:
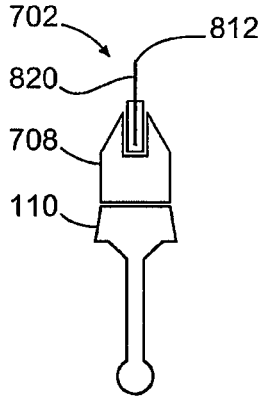
FIG. 8 is a side view of a sixth embodiment of a detachable head with a working tool that can be used with the system shown in FIG. 1.

FIG. 8 is a side view of a sixth embodiment of a detachable head that can be used with the system 100 shown in FIG. 1. Instead of razor 720, a scraper blade 820 can be placed within the holder of the element 708, the scraper having a relatively dull distal edge 812 as compared, for example, to the sharp edge of a razor blade.

The embodiments of the head described with reference to FIGS. 3-8 are merely examples and are not intended to limit the scope of this disclosure. These embodiments merely illustrate the types of working elements that can be attached to the base 110 of the detachable head. A person of skill would recognize that any of the identified elements could be combined or altered to produce an alternative embodiment of a removable head. For example, a head featuring a working element that includes bristles, a sponge, a roller, a razor, a scraper or a wire bristle brush may be any of the described widths and may have any of the described shaped distal edges or back portions. In this manner, a single system 100 can be used with a variety of different heads 102 having a range of sizes, a variety of uses and formed from a variety of materials.

Figure 10:
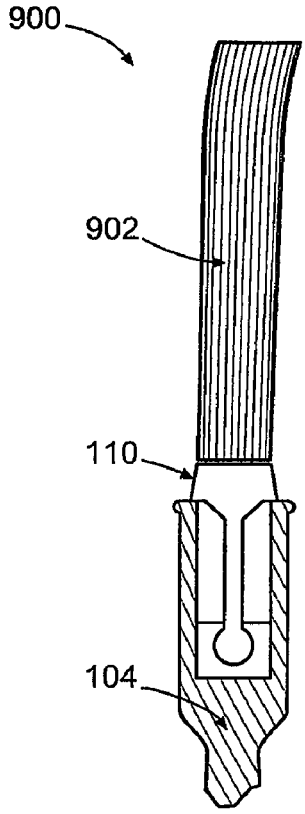
FIG. 10 is a partial cut-away side view of the embodiment of the system of FIG. 9.
Figure 9:
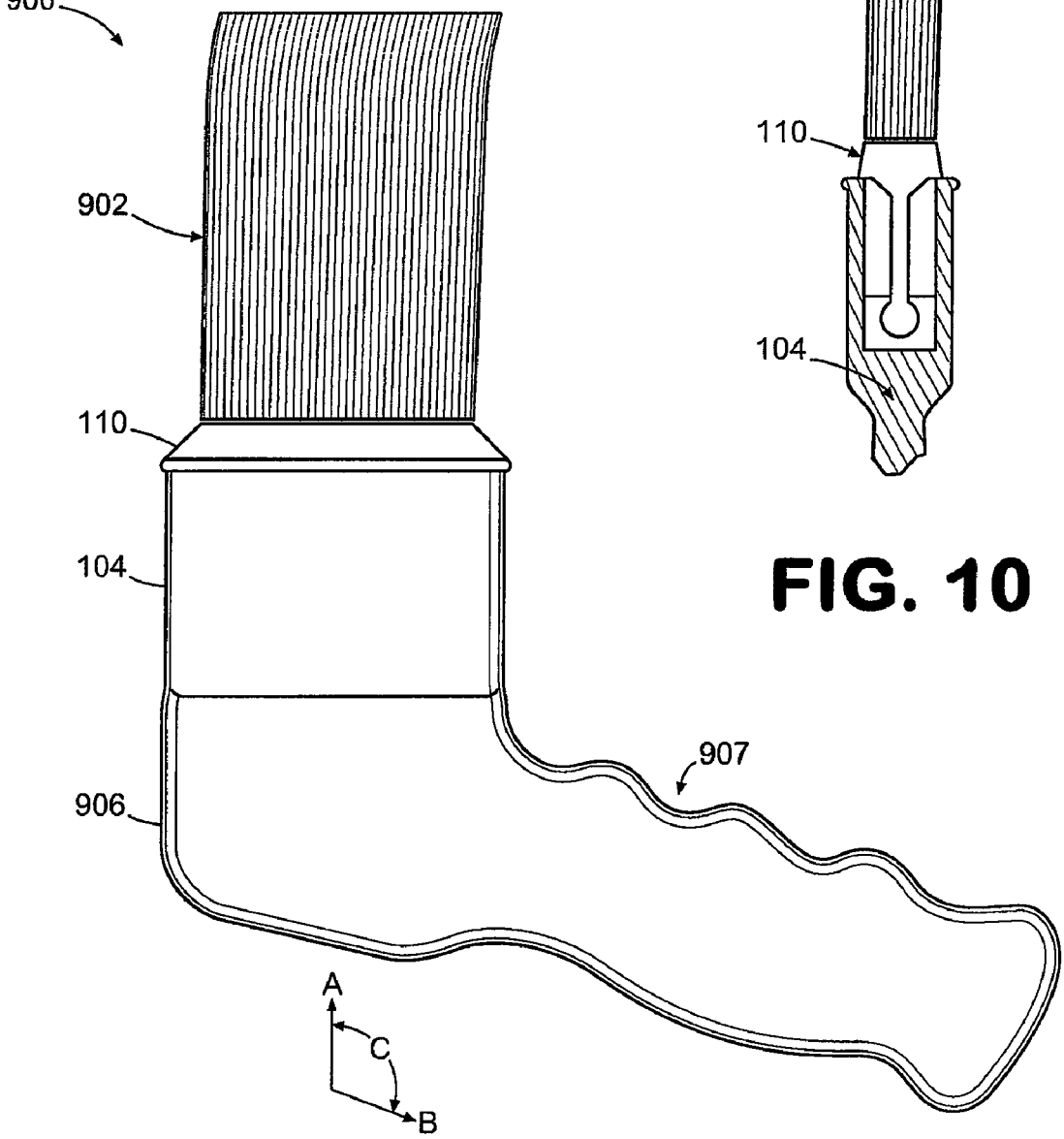
FIG. 9 is a front view of a second embodiment of a system having a detachable head, the system having an offset handle.
Figure 11A:
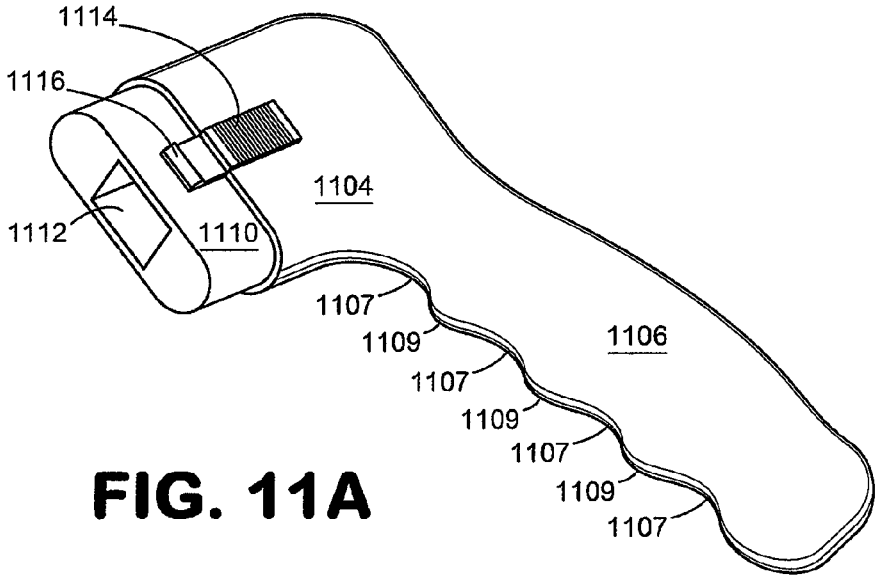
FIGS. 11 A-F illustrate a third embodiment of the present tool system having one or more biasing means for attaching and/or removing an alternate detachable head, including the offset handle of FIG. 9.
Figure 11B:
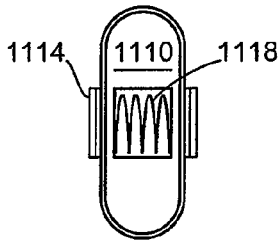
Figure 11C:
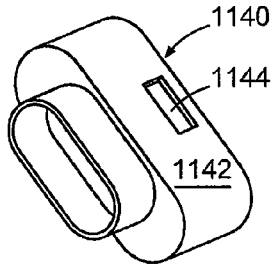
Figure 11E:
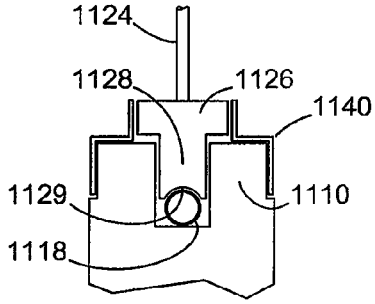
Figure 11D:
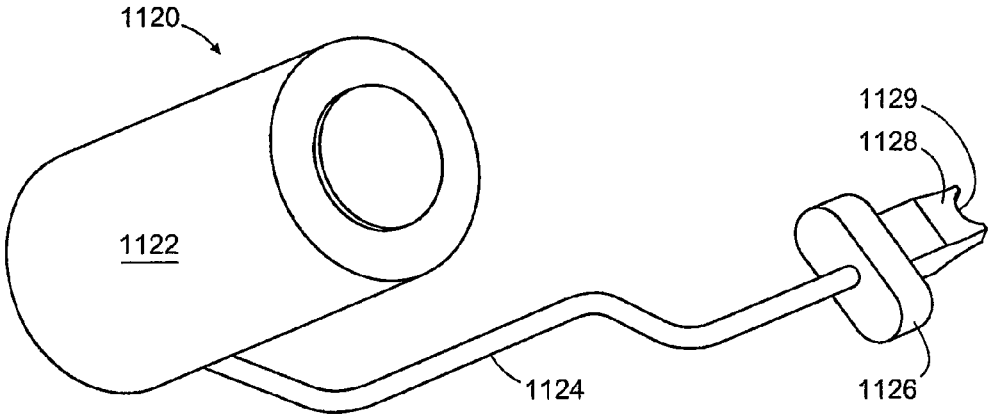
Figure 11F:
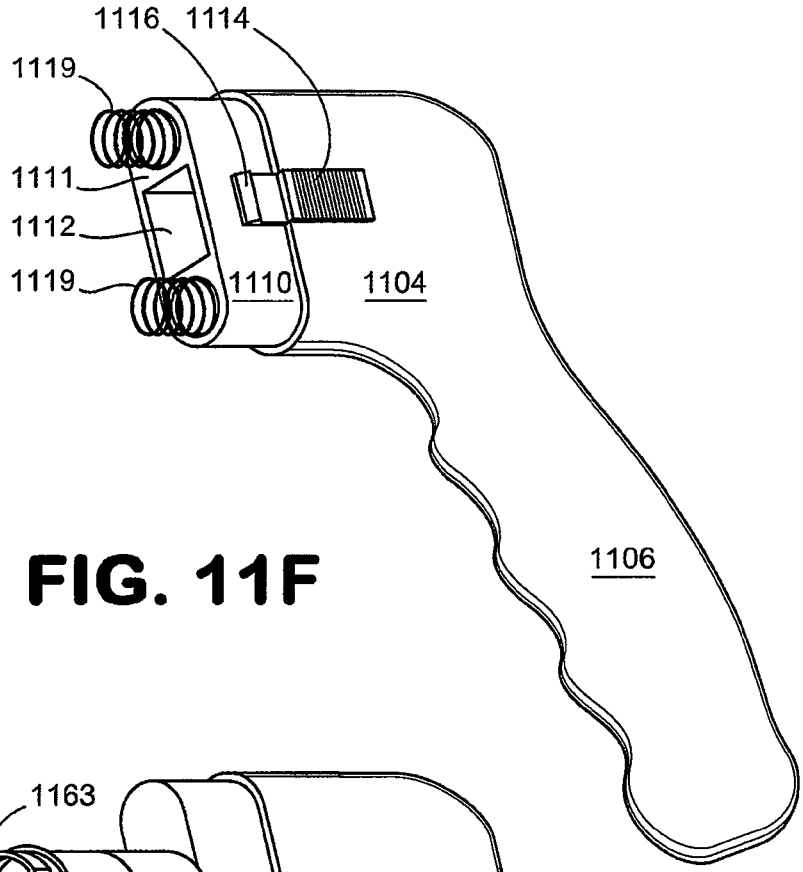

FIG. 9 is a front view of a further embodiment of a tool system 900 having a detachable head 902, for example a brush, having an offset handle 906. Like the system 100 described above with reference to FIGS. 1-2, system 900 includes a detachable head 902, a body 104, and a handle 906 extending from the body 104. The detachable head 902 may be anyone of the embodiments of a detachable head described above having the base 110 that is configured to mate with the body 104. The body 104 is identical to the body described above with reference to FIG. 2, as shown in FIG. 10, which is a partial cut-away side view of the embodiment of the brush 900 of FIG. 9 illustrating the interior of the body 104 engaged by the base 110 of the head 902.

In this embodiment the handle 906 is offset at an angle from the body 104 of the system 100. More particularly, the detachable head 902 and the body 104 of the system are substantially aligned along an axis A, and handle 906 is substantially aligned along an axis B, different than axis A, which forms an angle C with axis A. Angle C may be in the range of about 100 degrees to about 170 degrees. In an exemplary embodiment angle C may be in the range of about 110 degrees to about 160 degrees. In a further embodiment angle C may be in the range of 112 degrees to 158 degrees. In yet a further embodiment, as shown, the angle C is about 120 degrees.

The handle 906 is molded plastic, but may be formed by other processes or from other materials in other embodiments. For example, the handle 906 may be wood. The handle 906 is elongated with respect to the body 104, for example about 1.5 inches wide and about 4.5 inches long.

In the embodiment shown, the handle 906 has scallops, grooves or indentations 907. The grooves 907 may be molded into the plastic on a side of the handle 906 nearest the body 104. The grooves 907, however, are not necessary and may be omitted in embodiments that are not shown.

FIGS. 11 A-F illustrate a third embodiment of a system 1100 for use with a detachable head, illustrating a handle 1106 of the system. Like the system 900 shown in FIG. 9, the system 1100 works with a detachable head, and a body 1104 having an offset handle 1106 extending from the body. The body 1104 includes an extension member 1110 having a hollow 1112 therein and a plurality of flexible detent or tab members 1114, each having an outward extension 1116, that when pressed inwardly will flex and be received by the hollow 1112. As illustrated, the body may, though it need not have, substantially flat opposed sides on which the flexible members may be positioned. The detachable head (not shown in full) can include a snap-fitting ferrule 1140 (FIG. 11 C) for attaching the working tool, for example, a brush to the head, and for detachably connecting the head 1102 to the body 1104. The ferrule 1140 has a hollow formed inside a peripheral wall section 1142, the hollow being complementary in shape to the extension member 1110 of the body 1104 for receiving the extension member. The ferrule can have spaces for receiving the outward extensions of the flexible members, for example, a plurality of windows 1144 formed in the wall or side section 1142, the windows 1144 being complimentary in shape and location to the outward extensions 1116 of the flexible detent members 1114 for receiving the outward extensions. The ferrule can also have substantially flat opposed sides 1142, complementary to the shape of the body, on which the windows are formed. The extension member 1110 of the body 1104, its flexible detent members 1114, the peripheral wall section 1142 of the ferrule 1140 of the head and the windows 1144 of the ferrule form means for releasably connecting the detachable head to the body. It should be noted that while the detachable head and ferrule are shown to be separate components, they may also be unitary in design in that the head may itself have a peripheral wall section forming a hollow for detachably receiving the extension member of the body.

The detachable head can include anyone of a variety of working tools of different sizes and shapes typically associated with painting, similar to those illustrated in FIGS. 3-8. For example, the head can include a paint applicator, such as a bristle brush, a sponge applicator, or a roller. The head can also include other tools associated with painting such as a paint scraper, a razor blade, a putt knife or a wire bristle brush.

The head including ferrule 1140 can be detached from the body 1104 by pressing the detents or tabs 1114 inwardly, which may be desirable in cases in which the head is coated with a substance such as paint. It should be noted that the design of the head and the body described above with reference to FIGS. 11 A-F may also be used in conjunction with a system that does not feature an offset handle, such as the brush 100 shown in FIG. 1.

Also like the system 900 shown in FIG. 9, the handle 1106 (FIG. 11A) includes grooves or indentations 1107. Specifically, the handle 1106 has four grooves. Each groove 1107 is connected to an adjacent groove 1107 by a curved section 1109. The handle 1106 can also include relief surfaces that extend from each groove 1107 into the handle 1106. The relief surfaces may be a reverse and partial spherical shape. It should be noted that the alternative design of the grooves 1107 of the handle 1106 described above with reference to FIG. 11 A may also be used in conjunction with the grooves 907 on the handle 906 of the system 900 shown in FIG. 9.

In FIG. 11 A, the hollow 1112 of the body 1104 is optionally provided with biasing means 1118 which serve to bias the flexible detent or tab members 1114 towards an outward position. In one form, the biasing means can be a spring seated inside the hollow 1112 serving to provide outward bias for the tab members 1114. In FIG. 11 0, the working head is a paint applicator in the form of a roller 1120. The roller 1120 consists of a roller head 1122 attached at one end of an arm 1124. Attached to the arm 1124 opposite the roller 1122 is an attachment member 1126 having an extension 1128 configured to fit within and be received by the hollow 1112 of the extension member 1110. Extension member 1128 may have a recess 1129 formed in its end for receiving biasing means 1118, thereby allowing room within the hollow 1112 for biasing means 1118 when roller 1120 is attached to the body 1104.

As illustrated in FIG. 11 F, the extension member 1110 of the handle body 1104 has a face 1111 which may optionally include one or more biasing means 1119. The biasing means can take the form of one or more springs seated in or attached to the face 1111 of the extension member 1110. Biasing means 1119 serve to facilitate removal of the detachable head, which in the embodiment illustrated in FIG. 11D is roller 1120. Thus, when tab members 1116 are pressed inwardly against the biasing means 1118 seated within the hollow 1112 of extension member 1110, biasing means 1119 will push against the detachable head aiding and separating the detachable head from the handle body 1104. One skilled in the art would understand that both biasing means 1118 and 1119 are optional and that the system 1100 may be provided without either biasing means, with only one of the biasing means or with both biasing means. Additionally, one skilled in the art would understand that, while two detent or tab members 1114 are illustrated along with complimentary windows 1144 of the ferrule 1140, system 1100 may be provided with one or more such detent or tab members 1114 along with one or more complimentary windows 1144.

Figure 12:
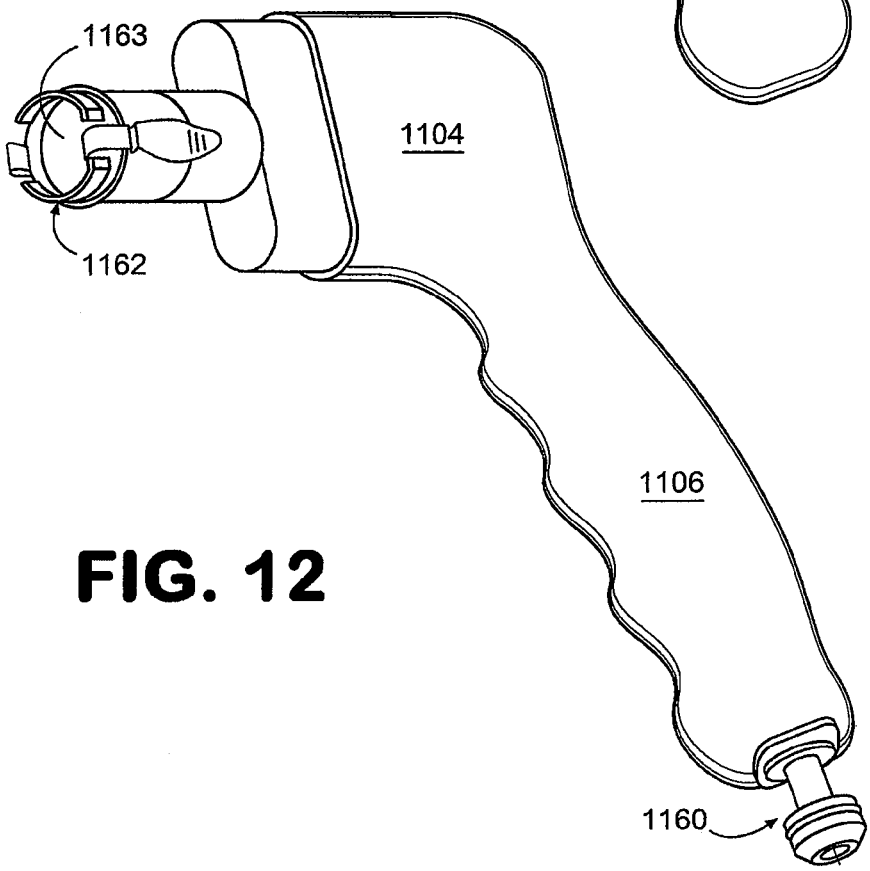
FIG. 12 illustrates a further embodiment of a handle and body having a hollow conduit through the interior of the handle.

Referring to FIG. 12, any of the above-described tool systems can be configured to be used with a paint pump. In such case, the distal end of the handle 1106 may have a coupling 1160 that is configured to couple a source of paint to be pumped through the handle. The coupling 1160 is a conventional coupling for a power paint system. A conduit or tubing extends through the coupling, and through the interior of the handle and the body to deliver paint from the paint pump to the head including a paint applicator. A second coupling 1162 having an interior hollow 1163 is provided for releasably connecting the head to the body 1104.

It should be emphasized that the above-described embodiments of the present paint tool system, particularly, any "preferred" embodiments, are merely possible examples of implementations and merely set forth for a clear understanding of the principles of the present disclosure. While particular embodiments of tool systems have been disclosed in detail in the foregoing description and drawings for purposes of example, those skilled in the art will understand that variations and modifications may be made without departing from the scope of the disclosure. All such variations and modifications are intended to be included within the scope of the present disclosure, as protected by the following claims.

I claim:

1. A paint tool system comprising:

a detachable head having a first and second end, including a working tool at the first end and an extension member extending from the second end, wherein the extension member has a proximal end, connected to the second end of the working tool, and a distal end; and a body including a handle extending therefrom, wherein the body includes a recess for receiving at least a portion of the extension member, the portion of the extension member including the distal end of the extension member, wherein the recess includes one or more flexible abutments for detachably securing the head to the body, wherein the portion of the extension member includes a section having a reduced thickness relative to the distal end, the section having a reduced thickness being located between the distal end and the proximal end of the extension member, and the one or more flexible abutments are designed to mate with the portion of the extension member having a reduced thickness.

2. The paint tool system of claim 1, wherein the distal end of the extension member is sized and shaped to fit securely and detachably within the recess.

3. The paint tool system of claim 2, wherein the recess includes one abutment for detachably securing the head to the body.

4. The paint tool system of claim 2, wherein the recess includes two or more abutments for detachably securing the head to the body.

5. The paint tool system of claim 1, wherein the working tool is selected from the group consisting of bristles, a sponge material, a paint roller, a razor blade, a scraping blade, and a wire brush.

6. The paint tool system of claim 2, wherein the body is substantially aligned along a first axis and the handle extends from the body along a second axis, the second axis being at an angle offset from the first axis.

7. The paint tool system of claim 6, wherein the angle is in the range of about 100 degrees to about 170 degrees.

8. The paint tool system of claim 1, wherein the body including the recess are aligned along a first axis and the handle extends from the body along a second axis, the second axis being at an angle offset from the first axis, and wherein the detachable head is connectable to the body along the first axis.

9. A paint tool system comprising:

a detachable head having a first and second end, including a working tool at the first end and an extension member extending from the second end, wherein the extension member has a proximal end, connected to the second end of the working tool, and a distal end; and a body including a handle extending therefrom, wherein the body includes a recess for receiving at least a portion of the extension member, the portion of the extension member including the distal end of the extension member, the portion of the extension member further including a section having a reduced thickness relative to the distal end, the section having a reduced thickness being located between the distal end and the proximal end of the extension member, wherein the recess includes one or more flexible abutments for detachably securing the head to the body, and the one or more flexible abutments are designed to mate with the portion of the extension member having a reduced thickness, and wherein the body is substantially aligned along a first axis and the handle extends from the body along a second axis, the second axis being at an angle offset from the first axis.

10. The paint tool system of claim 9, wherein the working tool is selected from the group consisting of bristles, a sponge material, a paint roller, a razor blade, a scraping blade, and a wire brush.

11. The paint tool system of claim 9, wherein the detachable head is connectable to the body along the first axis.

12. The paint tool system of claim 9, wherein the recess is sized and shaped to mate with the distal end of the extension member.

13. A paint tool kit comprising:

a paint tool system according to claim 1, wherein the paint tool system is packaged with one or more working tools having said detachable head, the one or more working tools selected from the group consisting of a bristle brush, a sponge applicator, a paint roller, a razor blade, a scraping blade, and a wire brush.

14. The paint tool kit of claim 13 wherein the body is substantially aligned along a first axis and the handle extends from the body along a second axis, the second axis being at an angle offset from the first axis.

15. A paint tool kit comprising:

a paint tool system according to claim 9 wherein the paint tool system is packaged with one or more working tools having said detachable head, the one or more working tools selected from the group consisting of a bristle brush, a sponge applicator, a paint roller, a razor blade, a scraping blade, and a wire brush.

16. The paint tool kit of claim 15, wherein the detachable head is connectable to the body along the first axis.

17. A paint tool system comprising:

a detachable head having a first and second end, including a working tool at the first end and an extension member extending from the second end, wherein the extension member has a proximal end, connected to the second end of the working tool, and a distal end; and a body including a handle extending therefrom, wherein the body includes a recess for receiving at least a portion of the extension member, the portion of the extension member including the distal end of the extension member, the portion of the extension member further including a section having a reduced thickness relative to the distal end, the section having a reduced thickness being located between the distal end and the proximal end of the extension member, at least one abutment member retained by the body within the recess of the body for detachably securing the head to the body, the at least one abutment member designed to mate with the portion of the extension member having a reduced thickness, and wherein the body is substantially aligned along a first axis and the handle extends from the body along a second axis, the second axis being at an angle offset from the first axis.

18. The paint tool system of claim 17, wherein the working tool is selected from the group consisting of bristles, a sponge material, a paint roller, a razor blade, a scraping blade, and a wire brush.

19. The paint tool system of claim 17, wherein the detachable head is connectable to the body along the first axis.

20. The paint tool system of claim 17, wherein the recess is sized and shaped to mate with the distal end of the extension member.

21. A paint tool kit comprising:

a paint tool system according to claim 17 wherein the paint tool system is packaged with one or more working tools having said detachable head, the one or more working tools selected from the group consisting of a bristle brush, a sponge applicator, a paint roller, a razor blade, a scraping blade, and a wire brush.

22. The paint tool kit of claim 17, wherein the detachable head is connectable to the body along the first axis.

* * * * *